United States Patent [19]

Eberhardt

[11] 4,031,348

[45] June 21, 1977

[54] PUSH-BUTTON ASSEMBLY SWITCH FOR WATCHES

[75] Inventor: Noel H. Eberhardt, Cupertino, Calif.

[73] Assignee: Microma Incorporated, Cupertino, Calif.

[22] Filed: Oct. 7, 1976

[21] Appl. No.: 730,527

Related U.S. Application Data

[63] Continuation-in-part of Ser. No. 633,853, Nov. 20, 1975, abandoned.

[52] U.S. Cl. ..... 200/159 R; 58/85.5; 200/264; 200/302

[51] Int. Cl.² ..... H01H 3/12

[58] Field of Search ..... 200/6 A, 159 R, 159 A, 200/159 B, 264, 302; 58/85.5, 90 R

[56] References Cited

UNITED STATES PATENTS

| | | | |
|---|---|---|---|
| 3,089,009 | 5/1963 | Korsgren, Sr. | 200/302 X |
| 3,737,605 | 6/1973 | Tobey et al. | 200/302 |
| 3,898,397 | 8/1975 | Devore | 200/302 X |
| 3,973,099 | 8/1976 | Morris | 200/159 R |

*Primary Examiner*—Volodymyr Y. Mayewsky
*Attorney, Agent, or Firm*—Blakely, Sokoloff, Taylor & Zafman

[57] ABSTRACT

An improved push-button assembly for a watch, particularly suitable for an electrical switch in a digital watch. A resilient sealing member disposed in a counter bore provides spring means and sealing means for a push-button member. In one embodiment the resilient member is conductive to assure electrical contact between the push-button member and the watch case.

4 Claims, 7 Drawing Figures

PUSH-BUTTON ASSEMBLY SWITCH FOR WATCHES

This is a continuation-in-part application of Ser. No. 633,853, filed Nov. 20, 1975 now abandoned.

BACKGROUND OF THE INVENTION

1. Field of the Invention

The invention relates to the field of push-button assemblies for watches.

2. Prior Art

In recent years digital wrist watches, such as those employing liquid crystal displays and light emitting diodes have become popular. Typically, in such watches, push buttons are utilized for activating electrical switches. For example, push buttons are utilized to display different watch functions such as seconds or calendar information. Push buttons are also used to activate lighting means for illuminating liquid crystal displays in dark environments. In digital watches employing light emitting diodes, information is not displayed until a push button, or the like, is depressed, this completes an electrical path and provides power to the light emitting diodes.

These push buttons and their assemblies most often employ a dynamic seal. This is necessary to prevent moisture ane other contaminants from entering the interior of the watch since such contaminants can adversely affect watch operation.

Often the push-button assemblies include a tube having an axially tapered bore for receiving a plunger. An O-ring is disposed about the plunger and a spring is used to provide tension on the push button. These push-button assemblies are relatively costly, provide a less than adequate seal and are an important consideration in digital watch reliability. Moreover, these push-button assemblies are sometimes damaged during installation which contributes to the overall problems of using these assemblies.

In contrast the invented and disclosed push-button assembly is relatively simple in construction when compared to the prior art assemblies, is substantially less expensive to fabricate, provides a more reliable assembly and a better seal.

SUMMARY OF THE INVENTION

An improved push-button assembly for a watch is described. A push-button member is employed which includes a button and a shaft, the shaft of this member is disposed within a bore and counter bore in the watch case. A resilient, generally cylindrical, sealing member is disposed about the shaft of the push-button member within the counter bore. The ends of the sealing member have a diameter less than the diameter of the counter bore; the central portion of this member has a greater diameter. This sealing provides both a seal and a spring means for returning the push-button member to its initial position.

DETAILED DESCRIPTION OF THE INVENTION

An improved push-button assembly for a watch such as a digital watch is described. The assembly is particularly suitable for use in watches which require electrical contact to be made, or broken, within the interior of the watch by a manually operated push button disposed on the exterior of the watch. The assembly may be used to complete, or break, an electrical path from the watch case to a member within the interior of the watch. Such an assembly may be used to selectively operate a light emitting diode display, activate lighting means for a liquid crystal display, select different watch functions, such as seconds, calendar information, etc., or to set the watch. Such watches operate at low voltages obtained from batteries, typically of approximately 1.5 volts.

Figure 1:
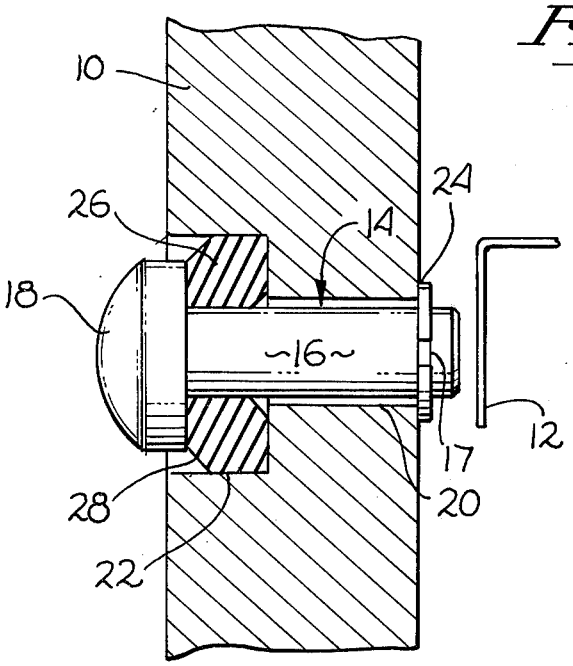
FIG. 1 is a cross-sectional view of an embodiment of the invented push-button assembly dispoed within a partially illustrated watch case. This view illustrates the assembly in its undepressed or initial position.

Referring first to FIG. 1 a portion of a watch case 10 is illustrated, which includes a bore 20 which bore is disposed through the watch case 10 so as to provide exterior access to the interior of the watch. A counter bore 22 is axially aligned with the bore 20 and provides a cylindrically shaped recess on the exterior surface of the watch. Typically, the bore 20 is disposed through the bezel of a wrist watch or at other convenient locations on the wrist watch.

The watch case 10 is most often fabricated from an electrically conductive material, such as brass, stainless steel, aluminum or a precious metal or alloy, such as gold or silver. The general function of the push-button assembly (including some prior art push-button assemblies) is to selectively provide an electrical path between the metal watch case 10 and an internal contact, such as contact 12. This path is completed upon the manual depression of the push button. While the invented push-button assembly is described in conjunction with the completion of an electrical path between the metal case 10 and the contact 12, it will be appreciated that the assembly may easily be used to break or interrupt an electrical path upon the depression of the push button.

Figure 2:
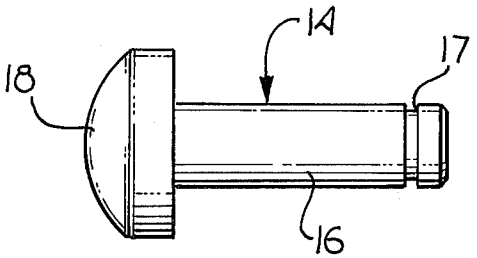
FIG. 2 is an elevation view of the push-button member employed in the push-button assembly of FIG. 1.

The push-button assembly comprises a push-button member 16, a snap ring 24, and a resilient washer 26. Referring now to FIG. 2, the generally cylindrical push-button member 14 includes a shaft 16 coaxially disposed on a push button 18. The push-button member 14 includes a circumferential groove 17 disposed adjacent to the distal end of shaft 16. This groove receives the snap ring 24 of FIG. 4. The push-button member 14 may be fabricated from metal such as stainless steel or brass employing known technology.

Figure 3:
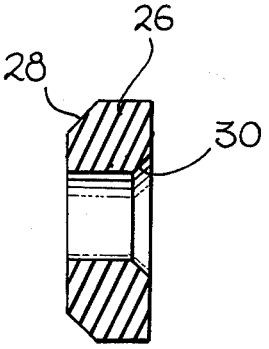
FIG. 3 is a cross-sectional view of a resilient washer employed in the push-button assembly of FIG. 1.

The washer 26 (FIG. 3) is a generally annular member fabricated from a resilient material such as silicon rubber. The exterior diameter of the washer 26 is such that the washer sealingly engages the counter bore 22 of the watch case 10, the surface of push button 18 facing the washer, and the annular surface between the bore 20 and counter bore 22. The inside diameter of the washer 26 is adaptable for sealingly engaging the shaft 16 of the pushbutton member 14. A chamfer 28 is disposed about one of the outer edges of the washer 26. The annular surface of the washer adjacent to chamfer 28 contacts a surface of the push button 18. A chamfer 30 is disposed between the other annular surface of the washer 26 and the interior bore of the washer as is shown in FIG. 3. In one embodiment of the invention, the washer 26 is fabricated from a conductive, resilient material such as silicon rubber impregnated with silver or carbon. This assures electrical contact between the push-button member 14 and the watch case 10.

Figure 4:
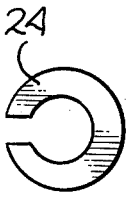
FIG. 4 is a plan view of a snap ring employed in the push-button assembly of FIG. 1.

In FIG. 4 the generally C-shaped snap ring 24 is shown; this ring engages the groove 17 of shaft 16. The ring 24 retains the shaft 16 of member 14 within the bore 20, thus a plurality of other known retaining means may be employed to perform this function. For the described embodiment, snap ring 24 may be a commonly employed snap ring.

Referring now to FIG. 1 to assemble the pushbutton assembly, the shaft 16 of the push-button member 14 is disposed through the interior bore of the washer 26 such that the annular surface adjacent to chamfer 28 engages the push button 18. Then, the shaft 16 is placed within the bore 20 allowing the washer 26 to sealingly engage the counter bore 22. The snap ring 24 is next urged onto the groove 17, thereby retaining the member 14 within the watch case 10.

The washer 26 is under a slight compression when the push button is in is relaxed (undepressed) position, such as is shown in FIG. 1. By way of example, it has been found that for a silicon rubber washer, a compression of 0.005 inches in the axial direction of the member 14 provides excellent results. This compression may be obtained by proper selection of the length of the shaft 16, the thickness of the washer 14, the depth of the counter bore 22, or by other apparent adjustments. Also it has been found that if the inside diameter of the washer 26 is approximately 0.01 inches less than the diameter of shaft 16, an acceptable seal is obtained between the shaft and washer.

Figure 5:
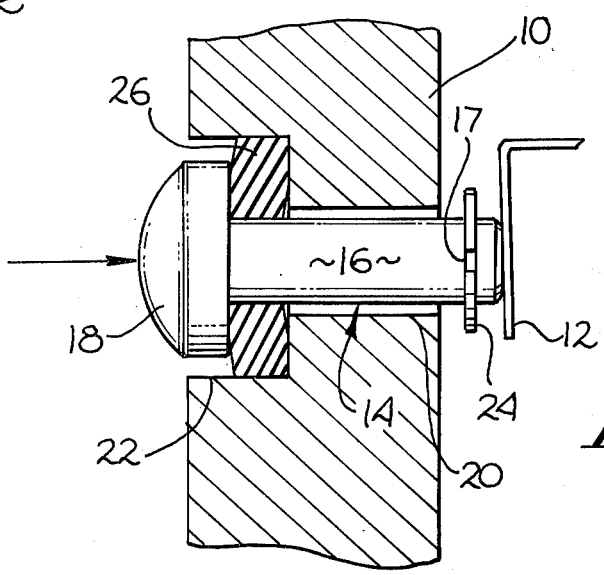
FIG. 5 illustrates the push-button assembly of FIG. 1 with the push-button member depressed so as to electrically contact a contact member disposed within the interior of the watch.

Referring now to FIG. 5 when the button 18 is manually depressed, the washer 26 is compressed and the distal end of shaft 16 is urged against the contact 12. When the button is depressed, it typically does not remain in perfect alignment with the bore 20, and hence the shaft 16 contacts the watch case 10 (not illustrated). This contact provides an electrical path between the case 10 and the shaft 16 and completes an electrical path between the case 10 and the contact 12. However, to assure electrical contact between the shaft 16 and case 10, a conductive washer 26 may be employed as described.

The washer 26 in addition to providing a dynamic seal also acts as a spring means for returning the push-button member 14 from its depressed position shown in FIG. 5 to its initial position shown in FIG. 1. The chamfer 28 of FIG. 3 assures that the washer may be readily compressed within the counter bore 22. The chamfer 30 of FIG. 3 adds resiliency to the washer when it is compressed against the annular surface of the counter bore.

Figure 6:
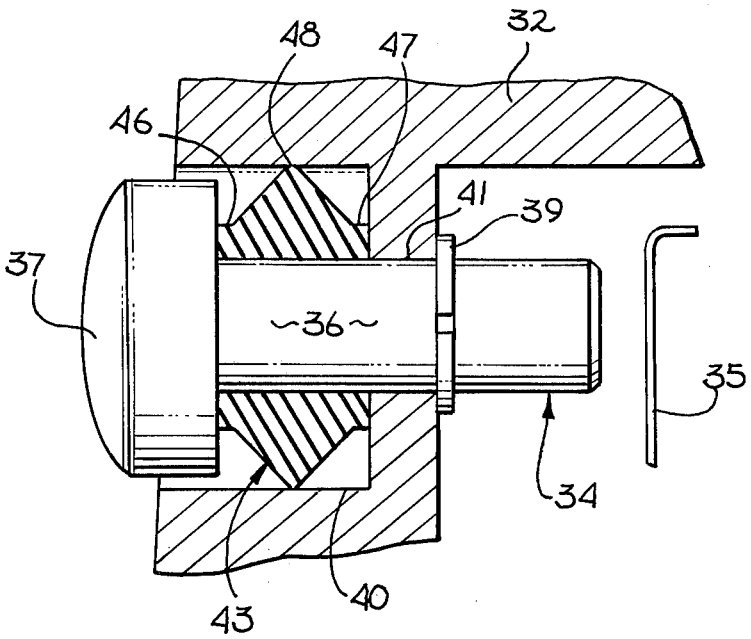
FIG. 6 is a cross-sectional view of the presently preferred embodiment of the invention disposed within a partially illustrated watch case. This view illustrates the assembly in its undepressed or initial position; and, FIG. 7 illustrates the assembly of FIG. 6 with the push button depressed.

Referring now to FIG. 6, the presently preferred embodiment of the push-button assembly is shown disposed within watch case 32. The assembly again includes a pushbutton member 34 having a shaft 36 and a button 37. This member is axially disposed within bore 41 and the counter bore 40. The shaft 36 closely fits within the bore 41 such that the shaft slidingly engages the bore. A snap ring 39 is emloyed as with the other embodiments, to retain the push-button member within the watch case. For the undepressed or initial position shown in FIG. 6 the shaft 36 is spaced-apart from the electrical contact 35.

In this embodiment the washer 26 of the previous embodiment is replaced with a resilient sealing member 43 which may be conductive. This generally cylindrical member is disposed about the shaft 36 within the counter bore 40. One end of this member defines a sleeve 46 which contacts button 37 while the other end defines a sleeve 47 which contacts the annular surface between counter bore 40 and bore 41. As is readily apparent from FIG. 6 the outside diameter of this sealing member at sleeves 46 and 47 is less than the diameter of the counter bore 40.

The sloping surfaces of the sealing member 43 between sleeves 46 and 47 converge at the rim 48 in contact with the wall of the counter bore 40. While in the presently preferred embodiment, as shown in FIG. 6, the sloping outside surfaces of the sealing member 43 are generally flat surfaces, a domed surface, parabolic surface or other like shaped surface may be disposed between the sleeves 46 and 47. An important feature of the sealing member 43 of FIG. 6 is that this member is symmetrical about a plane which includes the rim 48. The significance of this is that during assembly, unlike the previous embodiment, the shaft 36 may be placed into either end of this member. This is of substantial importance since the sealing member 43 and the washer 26 are quite small and thus difficult to examine, where examination is necessary for assembly.

Figure 7:
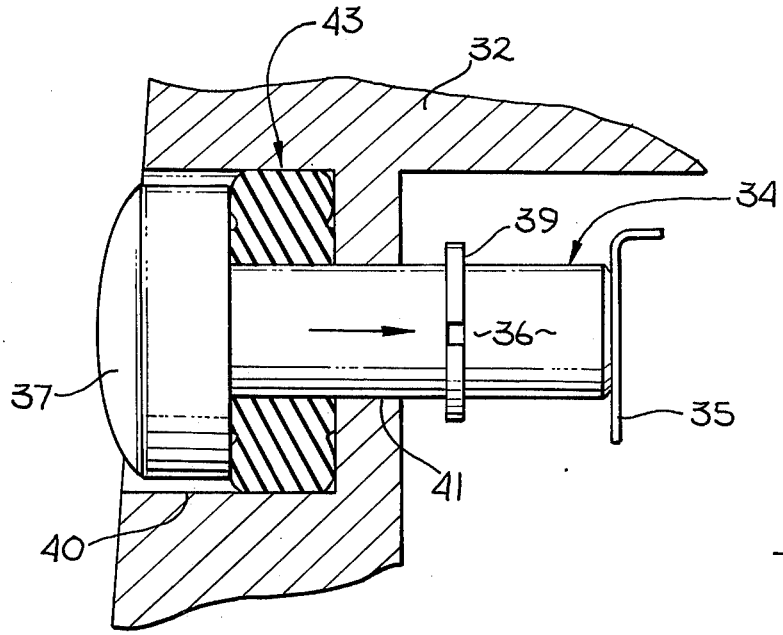

In FIG. 7 the push-button assembly is shown in the depressed position with the shaft 36 engaging contact 35. For this condition as is readily seen in FIG. 7 the sealing member is compressed within the counter bore. This sealing member as is in the case of the washer 26 provides a spring means for returning the push-button member 34 to its initial position. An excellent seal is provided with this embodiment, particularly since the sleeves remain firmly against the push-button at one end and the watch case at the other end (both in the initial position of FIG. 6 and the depressed position of FIG. 7). As was the case in the previous embodiment a slight pre-compression of the sealing member 46 exists in the undepressed position.

Thus, a push-button assembly for a wrist watch been disclosed which employs a resilient member to seal the interior of the watch and also as a spring means for returnng the push-button member to its undepressed position. The assembly is relatively simple when compared to prior art push-button assemblies and substantially more reliable.

I claim:

1. A low voltage push-button switch assembly for a watch for engaging a bore disposed through a watch case, said bore including a counter bore on the exterior surface of said watch case, comprising:

an electrical contact member disposed within said watch case;

a push-button member including a button and a shaft, said shaft slidingly engaging said bore for axial movement within said bore such that said shaft may be urged in contact with said electrical contact member;

a compressible, resilient, generally cylindrical integral sealing member engaging said shaft and disposed within said counter bore, the ends of said sealing member defining sleeves for engaging said shaft, the center portion of said sealing member having sloping surfaces that converge at the wall of said counter bore, said sealing member being symmetrical about a plane transverse to its axis; and retaining means for retaining said push-button member within said bore;

whereby when said button is depressed said shaft contacts said watch case within said bore and contacts said contact member thereby completing an electrical path between said contact member and watch case and whereby said sealing member acts as a spring means and sealing means for said push-button assembly.

2. The push-button assembly defined by claim 1 wherein one of said ends of said sealing member contacts said button and the other of said ends of said sealing member contacts an annular surface between said bore and counter bore.

3. The push-button assembly defined by claim 2 wherein said sealing member comprises a conductive material.

4. The push-button assembly defined by claim 1 wherein said retaining means comprises a snap ring engaging said shaft of said push-button member.

* * * * *

UNITED STATES PATENT OFFICE

CERTIFICATE OF CORRECTION

Patent No. 4,031,348 Dated June 21, 1977

Inventor(s) Noel H. Eberhardt

It is certified that error appears in the above-identified patent and that said Letters Patent are hereby corrected as shown below:

IN THE TITLE: PUSH-BUTTON ASSEMBLY SWITCH FOR WATCHES should read --PUSH-BUTTON SWITCH ASSEMBLY FOR WATCHES--

Column 1, Line 62: change "dispoed" to --disposed--

Column 3, Line 22: change "pushbutton" to --push-button--

Column 3, Line 68: change "pushbutton" to --push-button--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*